US010714033B2

(12) United States Patent
Choi et al.

(10) Patent No.: US 10,714,033 B2
(45) Date of Patent: Jul. 14, 2020

(54) DISPLAY PANEL DRIVING APPARATUS, METHOD OF DRIVING DISPLAY PANEL USING THE SAME AND DISPLAY APPARATUS HAVING THE SAME

(71) Applicant: SAMSUNG DISPLAY CO., LTD., Yongin-si, Gyeonggi-Do (KR)

(72) Inventors: Nam-Gon Choi, Yongin-si (KR); Dong-Won Park, Asan-si (KR); Seung-Hwan Moon, Asan-si (KR); Byung-Kil Jeon, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 425 days.

(21) Appl. No.: 15/000,747

(22) Filed: Jan. 19, 2016

(65) Prior Publication Data

US 2017/0025077 A1 Jan. 26, 2017

(30) Foreign Application Priority Data

Jul. 23, 2015 (KR) ..... 10-2015-0104510

(51) Int. Cl.
*G09G 3/36* (2006.01)

(52) U.S. Cl.
CPC ..... *G09G 3/3607* (2013.01); *G09G 3/3696* (2013.01); *G09G 2320/029* (2013.01)

(58) Field of Classification Search
None
See application file for complete search history.

(56) References Cited

U.S. PATENT DOCUMENTS

2002/0067451 A1 6/2002 Hattori et al.
2007/0257874 A1* 11/2007 Kim ..... G09G 3/3648 345/89
2008/0158119 A1* 7/2008 Park ..... G09G 3/3648 345/87
2012/0026439 A1* 2/2012 Jung ..... G02F 1/133753 349/110

(Continued)

FOREIGN PATENT DOCUMENTS

JP 2009-139629 6/2009
KR 1020070078005 7/2007

(Continued)

*Primary Examiner* — Andre L Matthews
(74) *Attorney, Agent, or Firm* — F. Chau & Associates, LLC

(57) ABSTRACT

A display panel driving apparatus includes a data processing part. The data processing part calculates a first pretilt value of previous image data to output a first pretilt signal, calculates a second pretilt value of current image data to output a second pretilt signal, analyze a luminance distribution of unit pixels from image data to output luminance distribution analysis data, analyzes a color pixel to which a pretilt is applied based on the unit pixel from the image data to output color analysis data, outputs a determination signal indicating whether the pretilt is applied to the image data, according to the luminance distribution analysis data and the color analysis data, and outputs pretilt compensation image data according to the first pretilt signal, the second pretilt signal and the determination signal, as compensation image data.

18 Claims, 12 Drawing Sheets

(56) References Cited

U.S. PATENT DOCUMENTS

| | | | | |
|---|---|---|---|---|
| 2012/0068999 | A1* | 3/2012 | Yoo | G09G 3/003 345/419 |
| 2012/0127191 | A1 | 5/2012 | Choi et al. | |
| 2012/0162191 | A1* | 6/2012 | Chen | G09G 3/3648 345/214 |

FOREIGN PATENT DOCUMENTS

| | | |
|---|---|---|
| KR | 1020080000201 | 1/2008 |
| KR | 1020080068486 | 7/2008 |
| KR | 1020080073909 | 8/2008 |
| KR | 1020120054959 | 5/2012 |

* cited by examiner

FIG. 7

430

| | GRAYSCALE VALUE | PDATA | | | | | | | | | | | | | | | | |
|---|---|---|---|---|---|---|---|---|---|---|---|---|---|---|---|---|---|---|
| | GRAYSCALE VALUE | 0 | 64 | 128 | 192 | 256 | 320 | 384 | 448 | 512 | 576 | 640 | 704 | 768 | 832 | 896 | 960 | 1024 |
| QDATA | 64 | 0 | 0 | 0 | 0 | 0 | 0 | 0 | 0 | 0 | 0 | 0 | 0 | 0 | 0 | 0 | 0 | 0 |
| | 128 | 0 | 0 | 0 | 0 | 0 | 0 | 0 | 0 | 0 | 0 | 0 | 0 | 0 | 0 | 0 | 0 | 0 |
| | 192 | 0 | 0 | 0 | 0 | 0 | 0 | 0 | 0 | 0 | 0 | 0 | 0 | 0 | 0 | 0 | 0 | 0 |
| | 256 | 0 | 0 | 0 | 0 | 0 | 0 | 0 | 0 | 0 | 0 | 0 | 0 | 0 | 0 | 0 | 0 | 0 |
| | 320 | 0 | 0 | 0 | 0 | 0 | 0 | 0 | 0 | 0 | 0 | 0 | 0 | 0 | 0 | 0 | 0 | 0 |
| | 384 | 0 | 0 | 0 | 0 | 0 | 0 | 0 | 0 | 0 | 0 | 0 | 0 | 0 | 0 | 0 | 0 | 0 |
| | 448 | 0 | 0 | 0 | 0 | 0 | 0 | 0 | 0 | 0 | 0 | 0 | 0 | 0 | 0 | 0 | 0 | 0 |
| | 512 | 0 | 0 | 0 | 0 | 0 | 0 | 0 | 0 | 0 | 0 | 0 | 0 | 0 | 0 | 0 | 0 | 0 |
| | 576 | 0 | 0 | 0 | 0 | 0 | 0 | 0 | 0 | 0 | 0 | 0 | 0 | 0 | 0 | 0 | 0 | 0 |
| | 640 | 0 | 0 | 0 | 0 | 0 | 0 | 0 | 0 | 0 | 0 | 0 | 0 | 0 | 0 | 0 | 0 | 0 |
| | 704 | 0 | 0 | 0 | 0 | 0 | 0 | 0 | 0 | 0 | 0 | 0 | 0 | 0 | 0 | 0 | 0 | 0 |
| | 768 | 0 | 0 | 0 | 0 | 0 | 0 | 0 | 0 | 0 | 0 | 0 | 0 | 0 | 0 | 0 | 0 | 0 |
| | 832 | 0 | 0 | 0 | 0 | 0 | 0 | 0 | 0 | 0 | 0 | 0 | 0 | 0 | 0 | 0 | 0 | 0 |
| | 896 | 0 | 0 | 0 | 0 | 0 | 0 | 0 | 0 | 0 | 0 | 0 | 0 | 0 | 0 | 0 | 0 | 0 |
| | 960 | 0 | 0 | 0 | 0 | 0 | 0 | 0 | 0 | 0 | 0 | 0 | 0 | 0 | 0 | 0 | 0 | 0 |
| | 1024 | 0 | 0 | 0 | 0 | 0 | 0 | 0 | 0 | 0 | 0 | 0 | 0 | 0 | 0 | 0 | 0 | 0 |

432

431

DISPLAY PANEL DRIVING APPARATUS, METHOD OF DRIVING DISPLAY PANEL USING THE SAME AND DISPLAY APPARATUS HAVING THE SAME

PRIORITY STATEMENT

This application claims priority under 35 U.S.C. § 119 to Korean Patent Application No. 10-2015-0104510, filed on Jul. 23, 2015 in the Korean Intellectual Property Office (KIPO), the contents of which are herein incorporated by reference in their entireties.

TECHNICAL FIELD

Exemplary embodiments of the present inventive concept relate to a display panel driving apparatus, a method of driving a display panel using the display panel driving apparatus, and a display apparatus having the display panel driving apparatus.

DISCUSSION OF RELATED ART

A liquid crystal display panel generally includes a lower substrate, an upper substrate and a liquid crystal layer. The lower substrate includes a first base substrate, a thin film transistor and a pixel electrode. The upper substrate includes a second base substrate and a common electrode. The liquid crystal layer includes a liquid crystal. A pixel voltage is applied to the pixel electrode. A common voltage is applied to the common electrode. An arrangement of the liquid crystal is changed by an electric field due to the pixel voltage and the common voltage.

SUMMARY

According to an exemplary embodiment of the present inventive concept, a display panel driving apparatus includes a processor, a data driver, and a gate driver. A frame memory unit is receives an image data and outputs a previous image data and a current image data. The processor determines a determination signal based on the current image data. The pretilt value calculator calculates a first pretilt value of the previous image data, calculates a second pretilt value of current image data and output a first pretilt signal and a second pretilt signal. An image data compensator outputs the image data or the pretilt compensation image data according to the first pretilt signal; the second pretilt signal and the determination signal, as compensation image data. The data driver generates a data signal based on the pretilt compensation image data output from the processor, and output the data signal to a data line of the display panel. The gate driver outputs a gate signal to a gate line of the display panel.

In an exemplary embodiment, the processor may include a luminance distribution analyzer, a color analyzer, and a pretilt determiner. A luminance distribution analyzer analyzes the luminance distribution of unit pixels from the current image data to output a luminance distribution analysis data, wherein each unit pixel includes M*N subpixels and M and N are natural number. A color analyzer analyzes one or more color pixels based on the unit pixel from the current image data to output a color analysis data. A pretilt determiner may output the determination signal indicating whether a pretilt is applied to the image data or the pretilt is not applied to the image data, according to the luminance distribution analysis data and the color analysis data.

In an exemplary embodiment, the unit pixel may include a first color pixel, a second color pixel and a third color pixel, and the color analyzer may indicate whether the pretilt is applied to one or more of the first to third color pixels and outputs the color analysis data.

In an exemplary embodiment, when the color analysis data output from the color analyzer indicates that the pretilt is applied to the first to third color pixels, the pretilt determiner may output a first determination signal indicating that the pretilt is applied to the image data.

In an exemplary embodiment, when the image data compensator receives the first determination signal from the pretilt determiner, the image data compensator may apply the pretilt to the image data based on the first pretilt value and the second pretilt value to output the pretilt compensation image data.

In an exemplary embodiment, when the color analysis data output from the color analyzer indicates that the pretilt is applied to one color pixel, the pretilt determiner may output a first determination signal indicating that the pretilt is applied to the image data.

In an exemplary embodiment, when the image data compensator receives the first determination signal from the pretilt determiner, the image data compensator may apply the pretilt to the image data based on the first pretilt value and the second pretilt value to output the pretilt compensation image data.

In an exemplary embodiment, when the color analysis data output from the color analyzer indicates that the pretilt is applied to two color pixels and the pretilt is not applied to one color pixel, the pretilt determiner may output a second determination signal indicating that the pretilt is not applied to the image data.

In an exemplary embodiment, when the image data compensator receives the second determination signal from the pretilt determiner, the image data compensator may not apply the pretilt to the image data and outputs the image data.

In an exemplary embodiment, the luminance distribution analysis data output from the luminance distribution analyzer may indicate a luminance similarity between the unit pixels.

In an exemplary embodiment, when the luminance similarity between the unit pixels is not less than a reference value according to the luminance distribution analysis data, the pretilt determiner may output a first determination signal indicating the pretilt is applied to the image data.

In an exemplary embodiment, the display panel may includes a first unit pixel having M*N subpixels and a second unit pixel having M*N subpixels. The image data compensator may apply a high pretilt to image data corresponding to the first unit pixel among the image data and may apply a low pretilt to image data corresponding to the second unit pixel among the image data, according to the determination signal output from a pretilt determiner.

In an exemplary embodiment, the image data compensator may include a first data compensator to output the pretilt compensation image data. A second data compensator may output a saturation grayscale image data corresponding to a maximum response speed of a liquid crystal in the display panel at a boundary section of data of a maximum black grayscale value and data of a minimum white grayscale value, when the previous image data has 0 to the maximum black grayscale value and the current image data has the minimum white grayscale value to a maximum white grayscale value. A look-up table may store a saturation grayscale value of the saturation grayscale image data corresponding to the previous image data and the current image data.

In an exemplary embodiment, the image data compensator may further include a look-up table area determiner may determine whether the previous image data and the current image data correspond to an area of the first data compensator, which is a first area of the look-up table or an area of the second data compensator, which is a second area of the look-up table, to output an area determination signal. A selector may selectively output the pretilt compensation image data and the saturation grayscale image data in response to the area determination signal.

In an exemplary embodiment, the image data compensator may include a first data compensator may output the pretilt compensation image data. A second data compensator may compensate the current image data based on the previous image data and the current image data to output an over-driving compensation image data using dynamic capacitance compensation. A third data compensator may interpolate the pretilt compensation image data and the over-driving compensation image data to output an interpolation compensation image data. A look-up table may store compensation grayscale values of the pretilt compensation image data, the over-driving compensation image data and the interpolation compensation image data corresponding to the previous image data and the current image data. A look-up table area determiner may determine whether the previous image data and the current image data correspond to an area of the first data compensator, which is a first area of the look-up table, an area of the second data compensator, which is a second area of the look-up table, or an area of the third data compensator, which is a third area of the look-up table, to output an area determination signal. A selector may selectively output the pretilt compensation image data, the over-driving compensation image data and the interpolation compensation image data in response to the area determination signal.

According to an exemplary embodiment of the present inventive concept, a method of driving a display panel includes receiving image data and outputting previous image data and current image data. Outputting a first pretilt signal based on a first pretilt value of the previous image data and outputting a second pretilt signal based on a second pretilt value of the current image data. A luminance distribution of unit pixels from the current image data is analyzed to output a luminance distribution analysis data. A color pixel to which a pretilt is applied based on the unit pixel from the current image data are analyzed to output color analysis data. A determination signal indicating whether the pretilt is applied to the image data or the pretilt is not applied to the image data is output according to the luminance distribution analysis data and the color analysis data. The image data or the pretilt compensation image data is output according to the first pretilt signal, the second pretilt signal and the determination signal.

The method may further include outputting a saturation grayscale image data corresponding to a maximum response speed of a liquid crystal in the display panel at a boundary section of data of a maximum black grayscale value and data of a minimum white grayscale value, when the previous image data has 0 to the maximum black grayscale value and the current image data has the minimum white grayscale value to a maximum white grayscale value, determining whether the previous image data and the current image data correspond to a first area of a look-up table or a second area of the look-up table to output an area determination signal, and selectively outputting the pretilt compensation image data and the saturation grayscale image data in response to the area determination signal.

The method may further include compensating the current image data based on the previous image data and the current image data to output an over-driving compensation image data using dynamic capacitance compensation. The image data is compensated by interpolating the pretilt compensation image data and the over-driving compensation image data to output an interpolation compensation image data. The previous image data and the current image data are determined whether they correspond to a first area of the look-up table, a second area of the look-up table, or a third area of the look-up table to output an area determination signal. The pretilt compensation image data, the over-driving compensation image data and the interpolation compensation image data are selectively output in response to the area determination signal.

According to an exemplary embodiment of the present inventive concept, a display apparatus includes a display panel and a display panel driver. The display panel driver includes a data driver, and a gate driver. A frame memory unit is receives an image data and outputs a previous image data and a current image data. The processor determines a determination signal based on the current image data. A pretilt value calculator calculates a first pretilt value of the previous image data, calculates a second pretilt value of current image data and output a first pretilt signal and a second pretilt signal. An image data compensator outputs the image data or the pretilt compensation image data according to the first pretilt signal, the second pretilt signal and the determination signal, as compensation image data. The data driver generates a data signal based on the pretilt compensation image data output from the processor, and output the data signal to a data line of the display panel. The gate driver outputs a gate signal to a gate line of the display panel.

In an exemplary embodiment, a display panel driver may include a luminance distribution analyzer, a color analyzer, and a pretilt determiner. The luminance distribution analyzer analyzes the luminance distribution of the unit pixels from the current image data to output the luminance distribution analysis data, wherein each unit pixel includes M*N subpixels and M and N are natural number. A color analyzer analyzes one or more color pixels based on the unit pixel from the current image data to output the color analysis data. A pretilt determiner outputs the determination signal indicating whether the pretilt is applied to the image data or the pretilt is not applied to the image data, according to the luminance distribution analysis data and the color analysis data.

According to an exemplary embodiment of the present inventive concept, a display apparatus includes a display panel and a display panel driver. The display panel driver includes a frame memory unit, a pretilt value calculator, a luminance distribution analyzer, a color analyzer, a pretilt determiner, an image data compensator, a data driver and a gate driver. The frame memory unit may receive an image data, and output a previous image data and a current image data. The pretilt value calculator may calculate a first pretilt value of the previous image data, calculate a second pretilt value of the current image data and output the first pretilt value and the second pretilt value. The luminance distribution analyzer may analyze a luminance distribution of the unit pixels from the current image data to output a luminance distribution analysis data. The color analyzer may analyze one or more color pixels based on the unit pixel from the current image data, to output a color analysis data. The pretilt determiner may output a determination signal indicating whether to apply the pretilt to the image data according to the luminance distribution analysis data and the color analysis data. The image data compensator may output the image data or a pretilt compensation image data according to the first pretilt value, the second pretilt value and the determination signal. The data driver may generate a data signal based on the image data or pretilt compensation image data and output the data signal to a data line of the display panel. The gate driver configured to output a gate signal to a gate line of the display panel.

In an exemplary embodiment, the image data compensator includes a first data compensator. The first data compensator may output the pretilt compensation image data by applying the first pretilt value and the second pretilt value to the image data when the determination signal is a first determination signal or the image data when the determination signal is a second determination signal.

In an exemplary embodiment, the image data compensator also includes a second data compensator, a look-up table, a look up table area determiner and a selector. The second data compensator may output a saturation grayscale image data based on a saturation grayscale value, the current image data and the previous image data when the determination signal is a second determination signal. The look-up table configured to store the saturation grayscale value of the saturation grayscale image data corresponding to the previous image data and the current image data. The look-up table area determiner may determine whether the previous image data and the current image data correspond to an area of the first data compensator, which is a first area of the look-up table or an area of the second data compensator, which is a second area of the look-up table, to output an area determination signal. The selector configured to selectively output the pretilt compensation image data, the image data and the saturation grayscale image data in response to the area determination signal.

In an exemplary embodiment, the image data compensator also includes a first data compensator, a second data compensator, a look-up table, a look up table area determiner and a selector. The first data compensator may output the pretilt compensation image data by applying a compensation grayscale image data, the first pretilt value and the second pretilt value to the image data when the determination signal is a first determination signal or the image data when the determination signal is a second determination signal. The second data compensator may output the over-driving compensation image data by applying the compensation grayscale image data to the image data when the determination signal is a second determination signal. The third data compensator may interpolate the pretilt compensation image data and the over-driving compensation image data to output interpolation compensation image data when the determination signal is a second determination signal. The look-up table may store compensation grayscale values of the pretilt compensation image data, the over-driving compensation image data and the interpolation compensation image data corresponding to the previous image data and the current image data. The look-up table area determiner may determine whether the previous image data and the current image data correspond to an area of the first data compensator, which is a first area of the look-up table, an area of the second data compensator, which is a second area of the look-up table, or an area of the third data compensator, which is a third area of the look-up table, to output an area determination signal. The selector may selectively output the pretilt compensation image data, the over-driving compensation image data and the interpolation compensation image data in response to the area determination signal.

In an exemplary embodiment, of the display panel driver each unit pixel includes M*N subpixels and M and N are natural numbers.

BRIEF DESCRIPTION OF THE DRAWINGS

Exemplary embodiments will now be described more fully hereinafter with reference to the accompanying drawings; however, they may be embodied in different forms and should not be construed as limited to the embodiments set forth herein.

In the figures, dimensions may be exaggerated for clarity of illustration. It will be understood that when an element is referred to as being "between" two elements, it can be the only element between the two elements, or one or more intervening elements may also be present. Like reference numerals refer to like elements throughout.

FIG. 7 is a concept diagram illustrating a look-up table of FIG. 6;

DETAILED DESCRIPTION

Hereinafter, the present inventive concept will be explained in detail with reference to the accompanying drawings.

Figure 1:
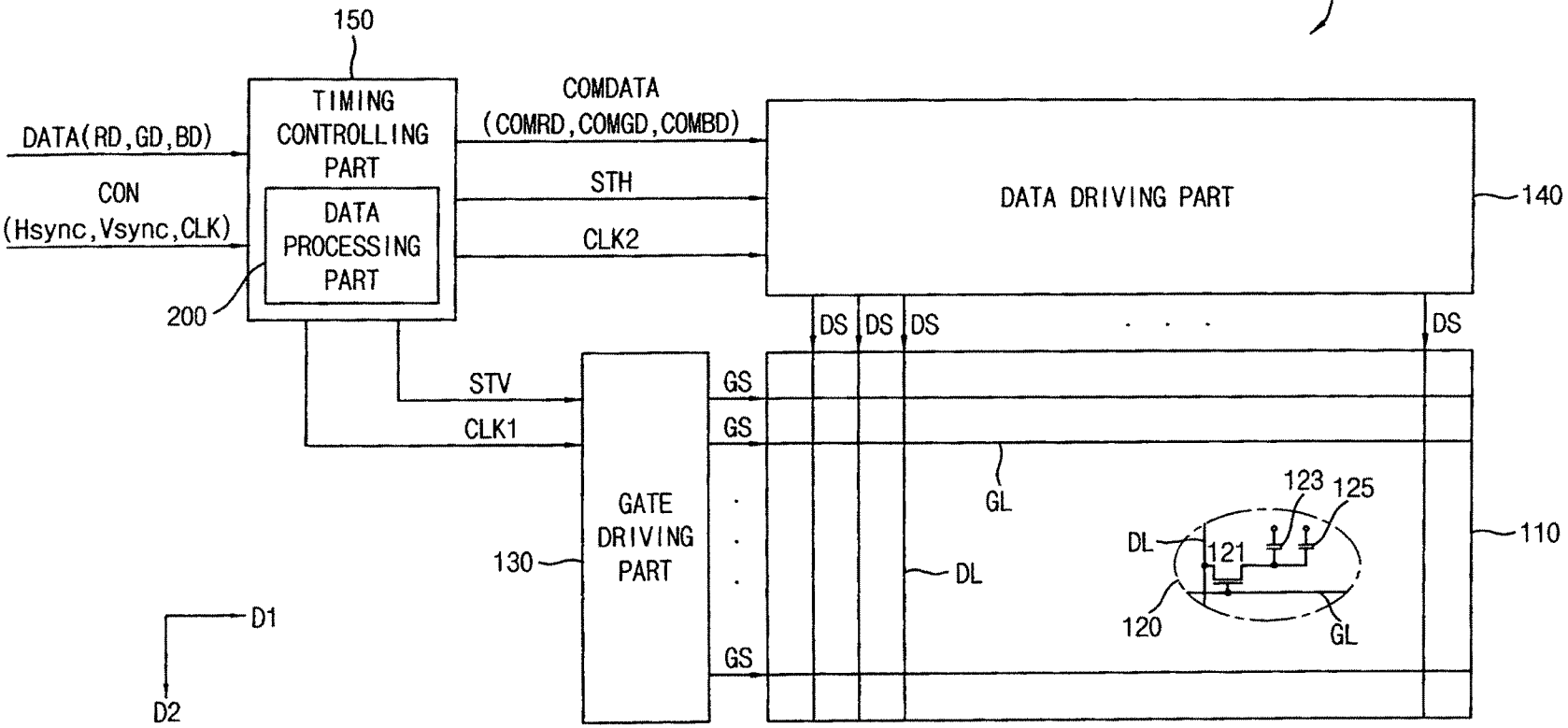
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus 100 according to the present exemplary embodiment includes a display panel 110, a gate driving part 130, a data driving part 140 and a timing controlling part 150.

The display panel 110 receives a data signal DS based on compensation image data COMDATA provided from the timing controlling part 150, e.g. a timing controller, to display an image. The display panel 110 includes gate lines GL, data lines DL and a plurality of pixels 120. The gate lines GL extend in a first direction D1 and are arranged in a second direction D2 substantially perpendicular to the first direction D1. The data lines DL extend in the second direction D2 and are arranged in the first direction D1. Each of the pixels 120 includes a thin film transistor 121 electrically connected to the gate line GL and the data line DL, a liquid crystal capacitor 123 and a storage capacitor 125 connected to the thin film transistor 121. The display panel 110 may be a liquid crystal display panel.

The gate driving part 130, e.g. a gate driver, generates a gate signal GS in response to a vertical start signal STV and a first clock signal CLK1 provided from the timing controlling part 150, and outputs the gate signal GS to the gate line GL.

The data driving part 140, e.g. a data driver, outputs the data signals DS to the data line DL in response to a horizontal start signal STH and a second clock signal CLK2 provided from the timing controlling part 150.

The timing controlling part 150 receives the input image data DATA_IN and a control signal CON from an outside. The control signal CON may include a horizontal synchronous signal Hsync, a vertical synchronous signal Vsync and a clock signal CLK. The timing controlling part 150 generates the horizontal start signal STH using the horizontal synchronous signal Hsync and outputs the horizontal start signal STH to the data driving part 140. In addition, the timing controlling part 150 generates the vertical start signal STV using the vertical synchronous signal Vsync and outputs the vertical start signal STV to the gate driving part 130. In addition, the timing controlling part 150 generates the first clock signal CLK1 and the second clock signal CLK2 using the clock signal CLK, outputs the first clock signal CLK1 to the gate driving part 130, and outputs the second clock signal CLK2 to the data driving part 140.

The timing controlling part 150 may include a data processing part 200, e.g. a processor. The data processing part 200 receives the image data DATA and outputs the compensation image data COMDATA. The image data DATA may include red data RD, green data GD and blue data BD. The compensation image data COMDATA may include compensation red data COMRD, compensation green data COMGD and compensation blue data COMBD.

Figure 2:
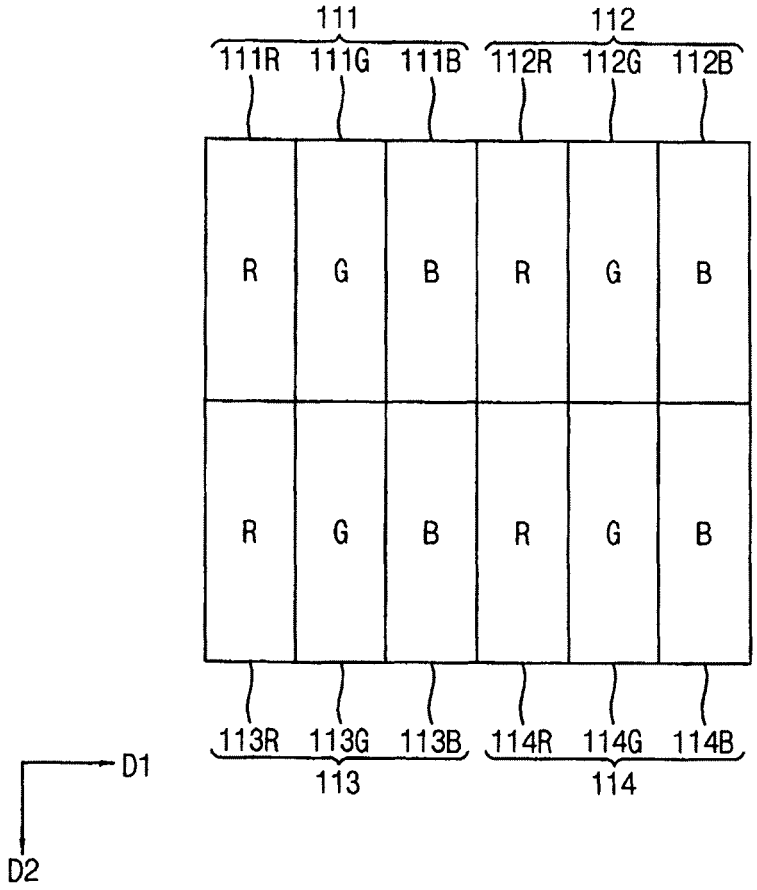
FIG. 2 is a plan view illustrating a display panel of FIG. 1.

FIG. 2 is a plan view illustrating the display panel 110 of FIG. 1.

Referring to FIG. 2, the display panel 110 may include a first unit pixel 111, a second unit pixel 112, a third unit pixel 113 and a fourth unit pixel 114.

Each of the unit pixels 111, 112, 113 and 114 may include M*N subpixels (M and N are natural numbers). For example, the first unit pixel 111 may include a first red subpixel 111R, a first green subpixel 111G and a first blue subpixel 111B. The second unit pixel 112 may include a second red subpixel 112R, a second green subpixel 112G and a second blue subpixel 112B. The third unit pixel 113 may include a third red subpixel 113R, a third green subpixel 113G and a third blue subpixel 113B. The fourth unit pixel 114 may include a fourth red subpixel 114R, a fourth green subpixel 114G and a fourth blue subpixel 114B.

In an exemplary embodiment, the display panel may include more than four unit pixels. The unit pixels in the display panel may be arranged in a grid including a plurality of columns and rows. For example, the display panel may have a plurality of unit pixels arranged in a grid of three or more columns and three or more rows.

Each color pixel is associated with a color. For example, each of the first red subpixel 111R, the second red subpixel 112R, the third red subpixel 113R and the fourth red subpixel 114R may be a first color pixel. Each of the first green subpixel 111G, the second green subpixel 112G, the third green subpixel 113G and the fourth green subpixel 114G may be a second color pixel. Each of the first blue subpixel 111B, the second blue subpixel 112B, the third blue subpixel 113B and the fourth blue subpixel 114B may be a third color pixel.

Figure 3:
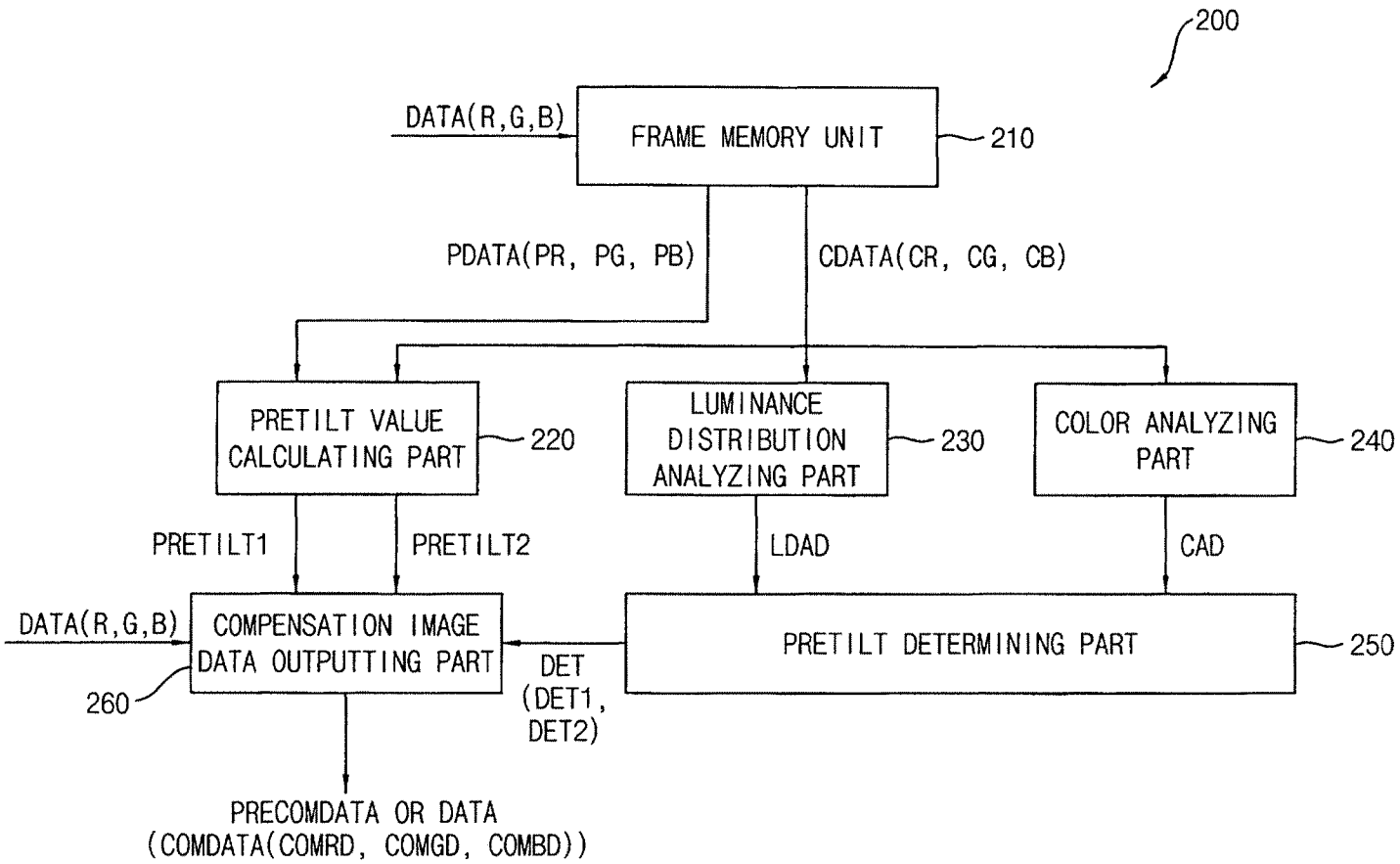
FIG. 3 is a block diagram illustrating a data processing part of FIG. 1.

FIG. 3 is a block diagram illustrating the data processing part 200 of FIG. 1.

Referring to FIGS. 1 to 3, the data processing part 200 may include a frame memory unit 210, a pretilt value calculating part 220, a luminance distribution analyzing part 230, a color analyzing part 240, a pretilt determining part 250 and a compensation image data outputting part 260.

The frame memory unit 210 receives and stores the image data DATA. The frame memory unit 210 may store and output previous image data PDATA and current image data CDATA of the image data DATA. The previous image data PDATA may include previous red data PR, previous green data PG and previous blue data PB. The current image data CDATA may include current red data CR, current green data CG and current blue data CB.

The pretilt value calculating part 220, e.g. the pretilt calculator, calculates a pretilt value of the previous image data PDATA to output a first pretilt signal PRETILT1 and calculates a pretilt value of the current image data CDATA to output a second pretilt signal PRETILT2. The first pretilt signal PRETILT1 may include a high pretilt value and a low pretilt value of each subpixel corresponding to the previous image data PDATA. In addition, the second pretilt signal PRETILT2 may include a high pretilt value and a low pretilt value of each subpixel corresponding to the current image data CDATA.

The luminance distribution analyzing part 230, e.g. the luminance distribution analyzer, analyzes a luminance distribution of the unit pixels 111, 112, 113 and 114 in the display panel 110 from the current image data CDATA of the image data DATA to output luminance distribution analysis data LDATA. The luminance distribution analyzing part 230 may analyze a luminance similarity between at least two of the unit pixels 111, 112, 113 and 114 to output the luminance distribution analysis data LDATA indicating the luminance similarity.

The color analyzing part 240, e.g. the color analyzer, analyzes a color pixel to which a pretilt is applied based on each of the unit pixels 111, 112, 113 and 114 from the current image data CDATA of the image data DATA to output color analysis data CAD. The color analyzing part 240 may analyze whether the pretilt is applied to the first to third color pixels, the pretilt is applied to one color pixel among the first to third color pixels, or the pretilt is applied to two color pixels among the first to third color pixels. Thus, the color analyzing part 240 may output the color analysis data CAD indicating whether the pretilt is applied to the first to third color pixels, the pretilt is applied to one color pixel among the first to third color pixels, or the pretilt is applied to two color pixels among the first to third color pixels.

The pretilt determining part 250, e.g. the pretilt determiner, outputs a determination signal DET according to the luminance distribution analysis data LDAD output from the luminance distribution analyzing part 230 and the color analysis data CAD output from the color analyzing part 240.

For example, when the color analysis data CAD output from the color analyzing part 240 indicates that the pretilt is applied to the first to third color pixels, the pretilt determining part 250 may output a first determination signal DET1 indicating that the pretilt is applied to the image data DATA.

In this case, the chroma of colors of the first to third color pixels may be 0 or low. When the chroma of the colors of the first to third color pixels is a reference value indicating a high chroma, the pretilt determining part 250 may output a second determination signal DET2 indicating that the pretilt is not applied to the image data DATA. In addition, when the color analysis data CAD output from the color analyzing part 240 indicates that the pretilt is applied to one color pixel among the first to third color pixels, the pretilt determining part 250 may output the first determination signal DET1 indicating that the pretilt is applied to the image data DATA. In addition, when the color analysis data CAD output from the color analyzing part 240 indicates that the pretilt is applied to two pixels among the first to third color pixels and the pretilt is not applied to one pixel among the first to third color pixels, the pretilt determining part 250 may output the second determination signal DET2 indicating that the pretilt is not applied to the image data DATA.

In addition, when the luminance similarity between at least two unit pixels among the unit pixels 111, 112, 113 and 114 is not less than a reference value according to the luminance distribution analysis data LDAD output from the luminance distribution analyzing part 230, the pretilt determining part 250 may output the first determination signal DET1 indicating that the pretilt is applied to the image data DATA. When the luminance similarity among the unit pixels 111, 112, 113 and 114 is less than the reference value according to the luminance distribution analysis data LDAD output from the luminance distribution analyzing part 230, the pretilt determining part 250 may output the second determination signal DET2 indicating that the pretilt is not applied to the image data DATA.

In addition, the pretilt determining part 250 may determine whether a high pretilt and a low pretilt are applied to the image data DATA. Thus, the determination signal DET may include information on whether the high pretilt and the low pretilt are applied to the image data DATA.

When the compensation image data outputting part 260, e.g. the image data compensator, receives the first determination signal DET1 from the pretilt determining part 250, the compensation image data outputting part 260 applies the pretilt to the image data DATA based on the first pretilt value of the first pretilt signal PRETILT1 and the second pretilt value of the second pretilt signal PRETILT2 to output pretilt compensation image data PRECOMDATA as the compensation image data COMDATA. In addition, when the compensation image data outputting part 260 receives the second determination signal DET2 from the pretilt determining part 250, the compensation image data outputting part 260 does not apply the pretilt to the image data DATA and outputs the image data DATA as the compensation image data COMDATA. In addition, the compensation image data outputting part 260 may apply the high pretilt to image data corresponding to the first unit pixel 111 among the image data DATA and apply the low pretilt to image data corresponding to the second unit pixel 112 among the image data DATA. Here, the second unit pixel 112 may be replaced with the third unit pixel 113 or the fourth unit pixel 114.

The gate driving part 130, the data driving part 140 and the timing controlling part 150 of FIG. 1 may be defined as a display panel driving apparatus which drives the display panel 110.

Figure 4:
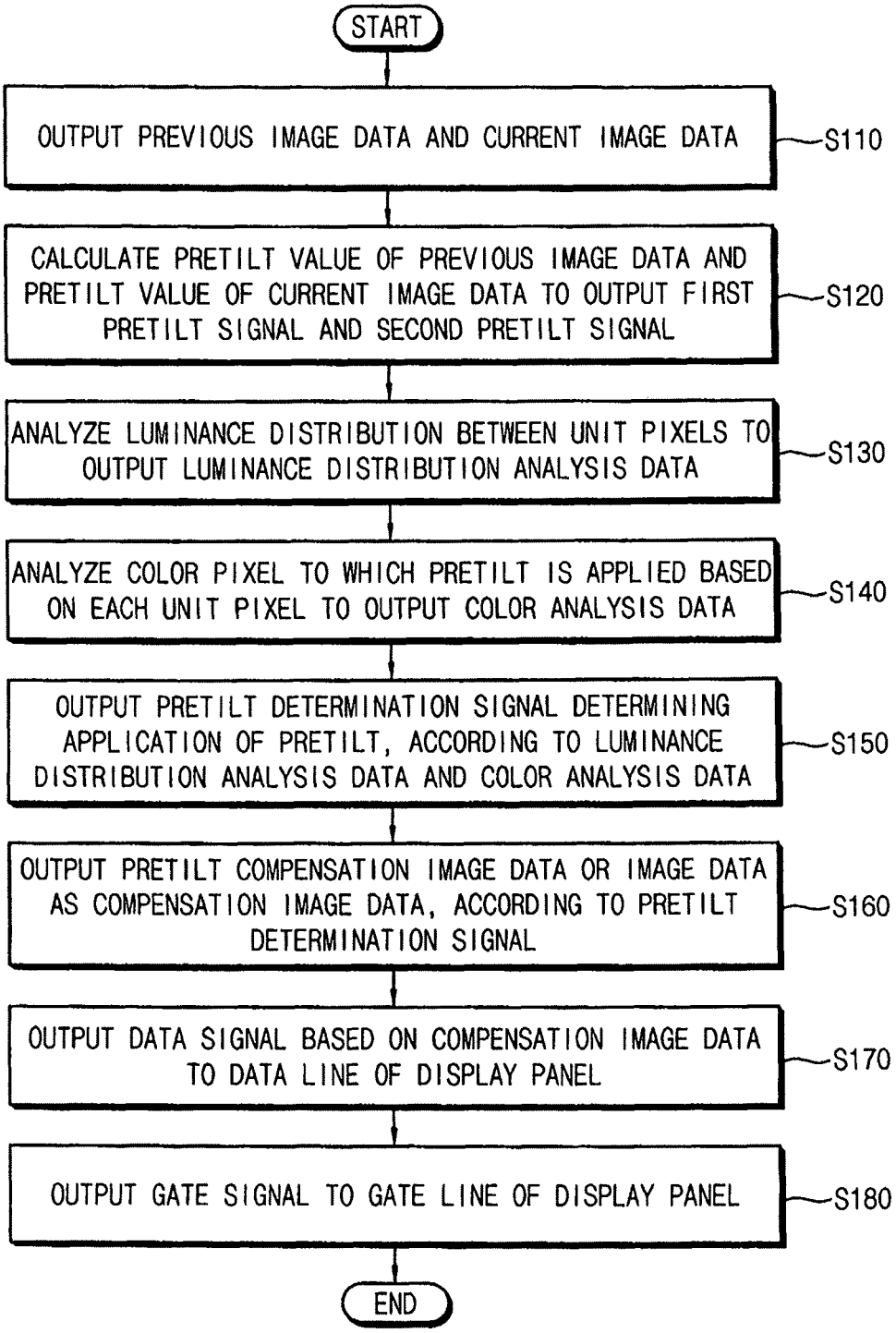
FIG. 4 is a flow chart illustrating a method of driving a display panel performed by a display panel driving apparatus of FIG. 1.

FIG. 4 is a flow chart illustrating a method of driving a display panel performed by the display panel driving apparatus of FIG. 1.

Referring to FIGS. 1 to 4, the previous image data PDATA and the current image data CDATA are output (step S110). For example, the frame memory unit 210 receives and stores the image data DATA. The frame memory unit 210 may store and output the previous image data PDATA and the current image data CDATA of the image data DATA.

The pretilt value of the previous image data PDATA and the pretilt value of the current image data CDATA are calculated to output the first pretilt signal PRETILT1 and the second pretilt signal PRETILT2 are output (step S120). For example, the pretilt value calculating part 220 calculates the pretilt value of the previous image data PDATA to output the first pretilt signal PRETILT1 and calculates the pretilt value of the current image data CDATA to output the second pretilt signal PRETILT2.

The luminance distribution among the unit pixels 111, 112, 113 and 114 are analyzed to output the luminance distribution analysis data LDAD (step S130). For example, the luminance distribution analyzing part 230 may analyze the luminance similarity between at least two of the unit pixels 111, 112, 113 and 114 from the current image data CDATA of the image data DATA to output the luminance distribution analysis data LDATA indicating the luminance similarity.

The color pixel to which the pretilt is applied is based on each of the unit pixels analyzed to output the color analysis data CAD (step S140). For example, the color analyzing part 240 analyzes the color pixel to which the pretilt is applied based on each of the unit pixels 111, 112, 113 and 114 from the current image data CDATA of the image data DATA to output the color analysis data CAD. The color analyzing part 240 may analyze whether the pretilt is applied to the first to third color pixels, the pretilt is applied to one color pixel among the first to third color pixels, or the pretilt is applied to two color pixels among the first to third color pixels. Thus, the color analyzing part 240 may output the color analysis data CAD indicating whether the pretilt is applied to the first to third color pixels, the pretilt is applied to one color pixel among the first to third color pixels, or the pretilt is applied to two color pixels among the first to third color pixels.

The determination signal DET determining whether the pretilt is applied to the image data DATA or the pretilt is not applied to the image data DATA is output according to the luminance distribution analysis data LADA and the color analysis data CAD (step S150). For example, the pretilt determining part 250 outputs the determination signal DET according to the luminance distribution analysis data LDAD output from the luminance distribution analyzing part 230 and the color analysis data CAD output from the color analyzing part 240.

The color analysis data CAD output from the color analyzing part 240 indicates that the pretilt is applied to the first to third color pixels, the pretilt determining part 250 may output the first determination signal DET1 indicating that the pretilt is applied to the image data DATA. In addition, when the color analysis data CAD output from the color analyzing part 240 indicates that the pretilt is applied to one color pixel among the first to third color pixels, the pretilt determining part 250 may output the first determination signal DET1 indicating that the pretilt is applied to the image data DATA. In addition, when the color analysis data CAD output from the color analyzing part 240 indicates that the pretilt is applied to two pixels among the first to third color pixels and the pretilt is not applied to one pixel among the first to third color pixels, the pretilt determining part 250 may output the second determination signal DET2 indicating that the pretilt is not applied to the image data DATA.

In addition, when the luminance similarity between at least two unit pixels among the unit pixels 111, 112, 113 and 114 is not less than the reference value according to the luminance distribution analysis data LDAD output from the luminance distribution analyzing part 230, the pretilt determining part 250 may output the first determination signal DET1 indicating that the pretilt is applied to the image data DATA. When the luminance similarity among the unit pixels 111, 112, 113 and 114 is less than the reference value according to the luminance distribution analysis data LDAD output from the luminance distribution analyzing part 230, the pretilt determining part 250 may output the second determination signal DET2 indicating that the pretilt is not applied to the image data DATA.

In addition, the pretilt determining part 250 may determine whether the high pretilt and the low pretilt are applied to the image data DATA. Thus, the determination signal DET may include the information on whether the high pretilt and the low pretilt are applied to the image data DATA.

The pretilt compensation image data PRECOMDATA or the image data DATA is output as the compensation image data COMDATA according to the determination signal DET (step S160). For example, when the compensation image data outputting part 260 receives the first determination signal DET1 from the pretilt determining part 250, the compensation image data outputting part 260 applies the pretilt to the image data DATA based on the first pretilt value of the first pretilt signal PRETILT1 and the second pretilt value of the second pretilt signal PRETILT2 to output pretilt compensation image data PRECOMDATA as the compensation image data COMDATA. In addition, when the compensation image data outputting part 260 receives the second determination signal DET2 from the pretilt determining part 250, the compensation image data outputting part 260 does not apply the pretilt to the image data DATA and outputs the image data DATA as the compensation image data COMDATA. In addition, the compensation image data outputting part 260 may apply the high pretilt to image data corresponding to the first unit pixel 111 among the image data DATA and apply the low pretilt to image data corresponding to the second unit pixel 112 among the image data DATA.

The data signal DS based on the compensation image data COMDATA is output to the data line DL of the display panel 110 (step S170). For example, the data driving part 140 outputs the data signals DS based on the compensation image data COMDATA to the data line DL in response to the horizontal start signal STH and the second clock signal CLK2 provided from the timing controlling part 150.

The gate signal GS is output to the gate line GL of the display panel 110 (step S180). For example, the gate driving part 130 generates the gate signal GS in response to the vertical start signal STV and the first clock signal CLK1 provided from the timing controlling part 150, and outputs the gate signal GS to the gate line GL.

According to the present exemplary embodiment, the data processing part 200 applies the pretilt to the image data DATA to output the compensation image data COMDATA. The pretilt is applied according to the luminance distribution of the unit pixels 111, 112, 113 and 114 and the color pixel to which the pretilt is applied is based on each of the unit pixels 111, 112, 113 and 114. Therefore, a response speed of a liquid crystal in the display panel 110 may be increased and a color distortion may be prevented.

Figure 5:
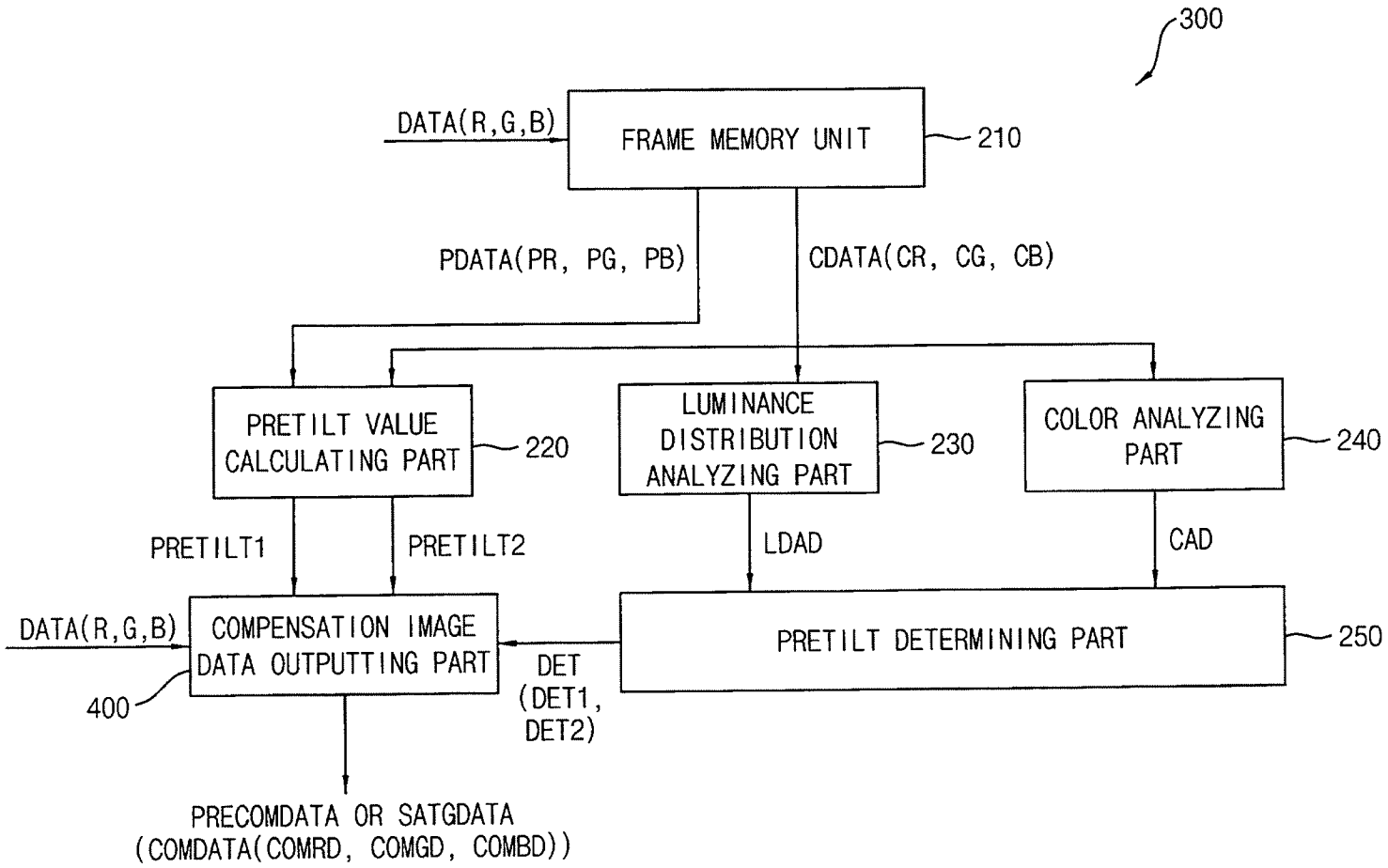
FIG. 5 is a block diagram illustrating a data processing part according to an exemplary embodiment of the present inventive concept.

FIG. 5 is a block diagram illustrating a data processing part 300 according to an exemplary embodiment of the present inventive concept. The data processing part 300 according to the present exemplary embodiment illustrated in FIG. 5 may be included in the display apparatus 100 according to the previous exemplary embodiment illustrated in FIG. 1, and is substantially the same as the data processing part 200 according to the previous exemplary embodiment illustrated in FIGS. 1 and 3 except for a compensation image data outputting part 400. Thus, the same reference numerals will be used to refer to same or like parts as those described in the previous exemplary embodiment and any further repetitive explanation concerning the above elements will be omitted.

Referring to FIG. 5, the data processing part 300 may include the frame memory 210, the pretilt value calculating part 220, the luminance distribution analyzing part 230, the color analyzing part 240, the pretilt determining part 250 and the compensation image data outputting part 400.

When the compensation image data outputting part 400 receives the first determination signal DET1 from the pretilt determining part 250, the compensation image data outputting part 400 applies the pretilt to the image data DATA based on the first pretilt value of the first pretilt signal PRETILT1 and the second pretilt value of the second pretilt signal PRETILT2 to output the pretilt compensation image data PRECOMDATA as the compensation image data COMDATA. In addition, when the compensation image data outputting part 400 receives the second determination signal DET2 from the pretilt determining part 250, the compensation image data outputting part 400 does not apply the pretilt to the image data DATA and outputs saturation grayscale image data SATGDATA as the compensation image data COMDATA. The saturation grayscale image data SATGDATA may correspond to a maximum response speed of the liquid crystal at a boundary section of data of a maximum black grayscale value and data of a minimum white grayscale value.

Figure 6:
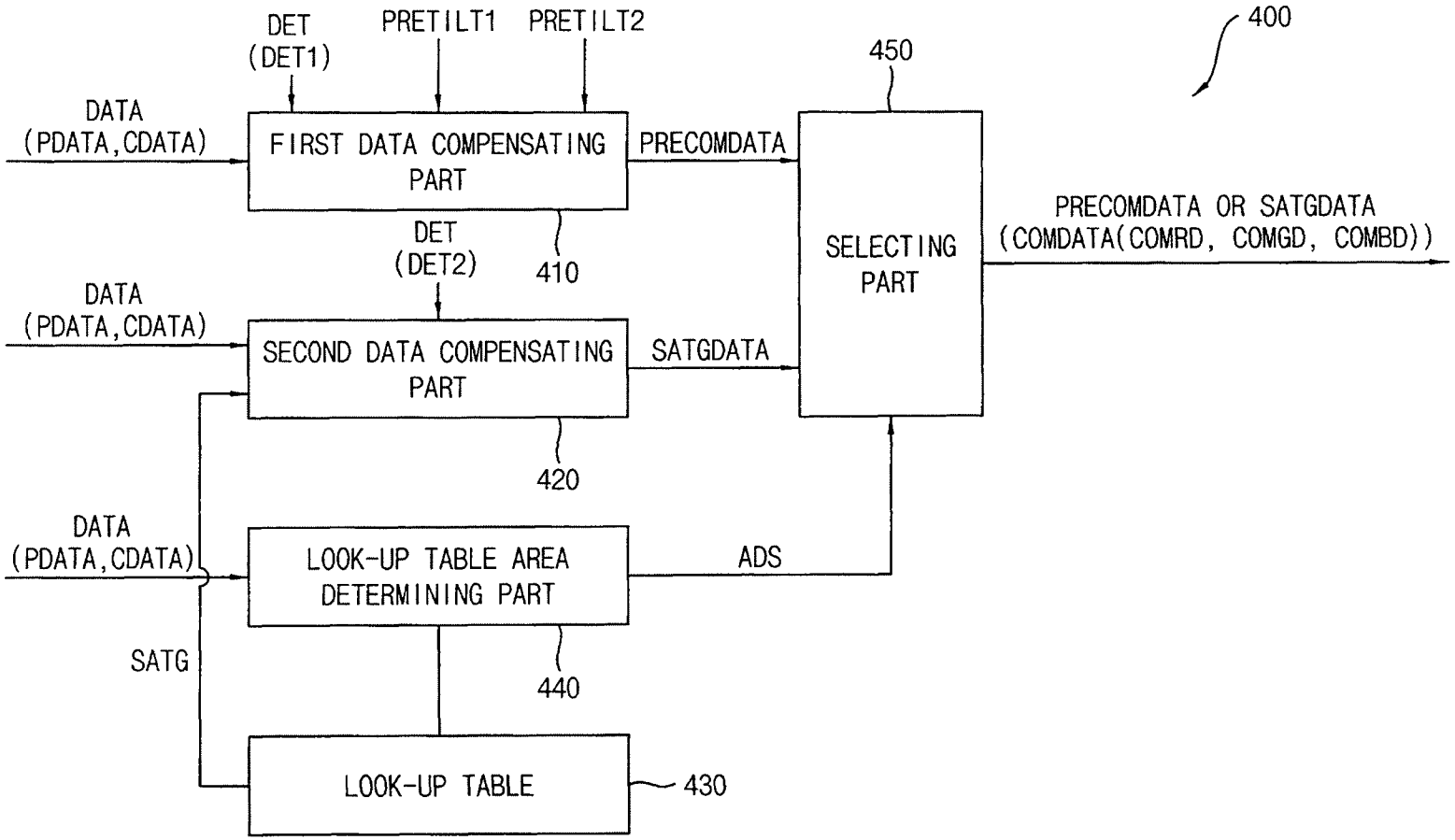
FIG. 6 is a block diagram illustrating a compensation image data outputting part of FIG. 5.

FIG. 6 is a block diagram illustrating the compensation image data outputting part 400 of FIG. 5.

Referring to FIGS. 5 and 6, the compensation image data outputting part 400 may include a first data compensating part 410, a second data compensating part 420, a look-up table 430, a look-up table area determining part 440 and a selecting part 450.

When the first data compensating part 410, e.g. a first data compensator, receives the first determination signal DET1 of the determination signal DET from the pretilt determining part 250, the first data compensating part 410 applies the pretilt to the image data DATA based on the first pretilt value of the first pretilt signal PRETILT1 and the second pretilt value of the second pretilt signal PRETILT2 to output the pretilt compensation image data PRECOMDATA.

When the second data compensating part 420, e.g. a second data compensator, receives the second determination signal DET2 of the determination signal DET from the pretilt determining part 250, the second data compensating part 420 outputs the saturation grayscale image data SATGDATA based on the previous image data PDATA and the current image data CDATA of the image data DATA. The second data compensating part 420 may read a saturation grayscale value SATG from the look-up table 430 to output the saturation grayscale image data SATGDATA.

FIG. 7 is a concept diagram illustrating the look-up table 430 of FIG. 6.

Referring to FIGS. 6 and 7, the look-up table 430 stores the saturation grayscale value SATG of the saturation grayscale image data SATGDATA corresponding to the previous image data PDATA and the current image data CDATA.

The look-up table 430 may include a first area 431 and a second area 432. The first area 431 may be an area suitable for applying the pretilt to the image data DATA according to the previous image data PDATA and the current image data CDATA. Thus, the first area 431 may be an area associated with the first data compensating part 410. The second area 432 may be an area unsuitable for applying the pretilt to the image data DATA according to the previous image data PDATA and the current image data CDATA and suitable for outputting the saturation grayscale image data SATGDATA. Thus, the second area 432 may be an area associated with the second data compensating part 420.

The look-up table area determining part 440 determines whether the previous image data PDATA and the current image data CDATA correspond to the first area 431 or the second area 432 of the look-up table 430 to output an area determination signal ADS.

The selecting part 450, e.g. a selector, selectively outputs the pretilt compensation image data PRECOMDATA or the saturation grayscale image data SATGDATA in response to the area determination signal ADS output from the look-up table area determining part 440. For example, when the area determination signal ADS has a first level, the selecting part 450 may output the pretilt compensation image data PRECOMDATA as the compensation image data COMDATA. When the area determination signal ADS has a second level, which is different from the first level, the selecting part 450 may output the saturation grayscale image data SATGDATA as the compensation image data COMDATA.

Figure 8:
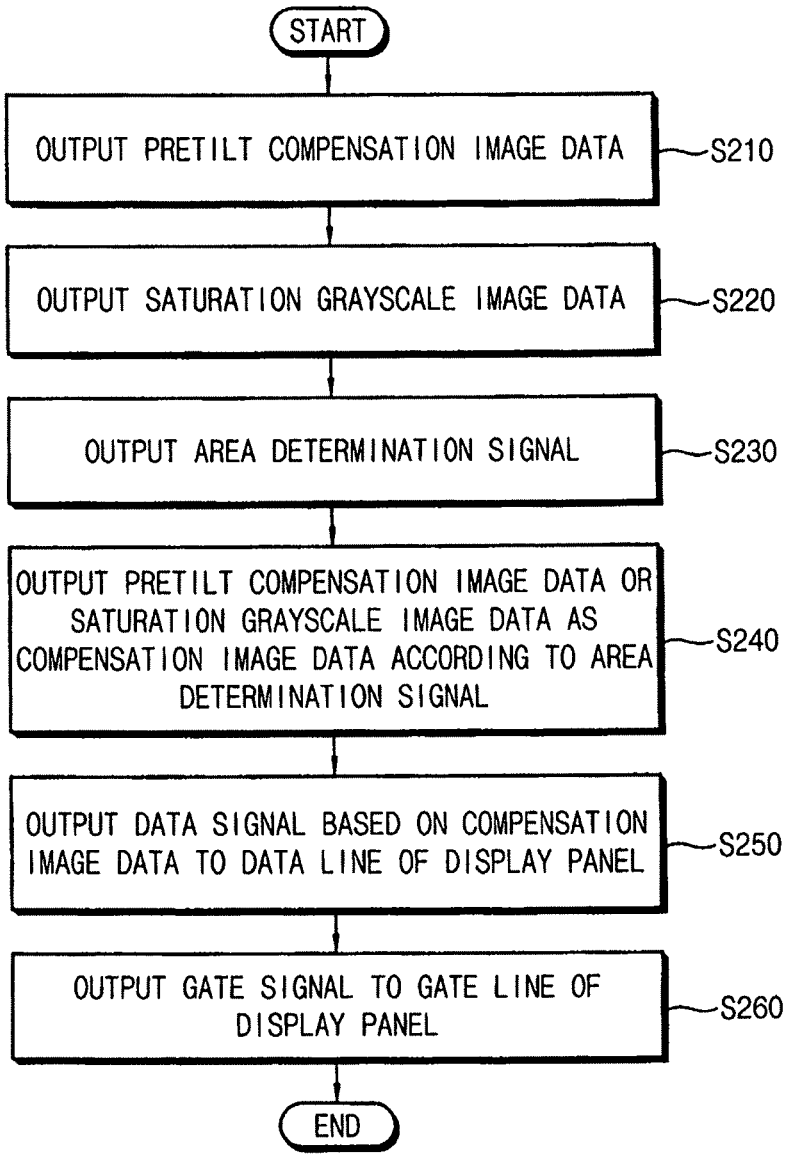
FIG. 8 is a flow chart illustrating a method of driving a display panel performed by a display panel driving apparatus including the data processing part of FIG. 5.

FIG. 8 is a flow chart illustrating a method of driving a display panel performed by a display panel driving apparatus including the data processing circuit 300 of FIG. 5.

Referring to FIGS. 1 and 5 to 8, the pretilt compensation image data PRECOMDATA is output (step S210). For example, when the first data compensating part 410 receives the first determination signal DET1 of the determination signal DET from the pretilt determining part 250, the first data compensating part 410 applies the pretilt to the image data DATA based on the first pretilt value of the first pretilt signal PRETILT1 and the second pretilt value of the second pretilt signal PRETILT2 to output the pretilt compensation image data PRECOMDATA.

The saturation grayscale image data SATGDATA is output (step S220). For example, when the second data compensating part 420 receives the second determination signal DET2 of the determination signal DET from the pretilt determining part 250, the second data compensating part 420 outputs the saturation grayscale image data SATGDATA based on the previous image data PDATA and the current image data CDATA of the image data DATA. The second data compensating part 420 may read the saturation grayscale value SATG from the look-up table 430 to output the saturation grayscale image data SATGDATA.

The area determination signal ADS is output (step S230). For example, the look-up table area determining part 440 determines whether the previous image data PDATA and the current image data CDATA correspond to the first area 431 or the second area 432 of the look-up table 430 to output the area determination signal ADS.

The pretilt compensation image data PRECOMDATA or the saturation grayscale image data SATGDATA is output as the compensation image data COMDATA according to the area determination signal ADS (step S240). For example, the selecting part 450 selectively outputs the pretilt compensation image data PRECOMDATA and the saturation grayscale image data SATGDATA in response to the area determination signal ADS output from the look-up table area determining part 440. For example, when the area determination signal ADS has the first level, the selecting part 450 may output the pretilt compensation image data PRECOMDATA as the compensation image data COMDATA. When the area determination signal ADS has the second level different from the first level, the selecting part 450 may output the saturation grayscale image data SATGDATA as the compensation image data COMDATA.

The data signal DS based on the compensation image data COMDATA is output to the data line DL of the display panel 110 (step S250). For example, the data driving part 140 outputs the data signals DS based on the compensation image data COMDATA to the data line DL in response to the horizontal start signal STH and the second clock signal CLK2 provided from the timing controlling part 150.

The gate signal GS is output to the gate line GL of the display panel 110 (step S260). For example, the gate driving part 130 generates the gate signal GS in response to the vertical start signal STV and the first clock signal CLK1 provided from the timing controlling part 150, and outputs the gate signal GS to the gate line GL.

According to the present exemplary embodiment, when it is not suitable for applying the pretilt to the image data DATA according to the previous image data PDATA and the current image data CDATA, the data processing part 300 does not apply the pretilt to the image data DATA. Therefore, a color distortion may be prevented. Thus, display quality of the display apparatus 100 may be improved.

Figure 9:
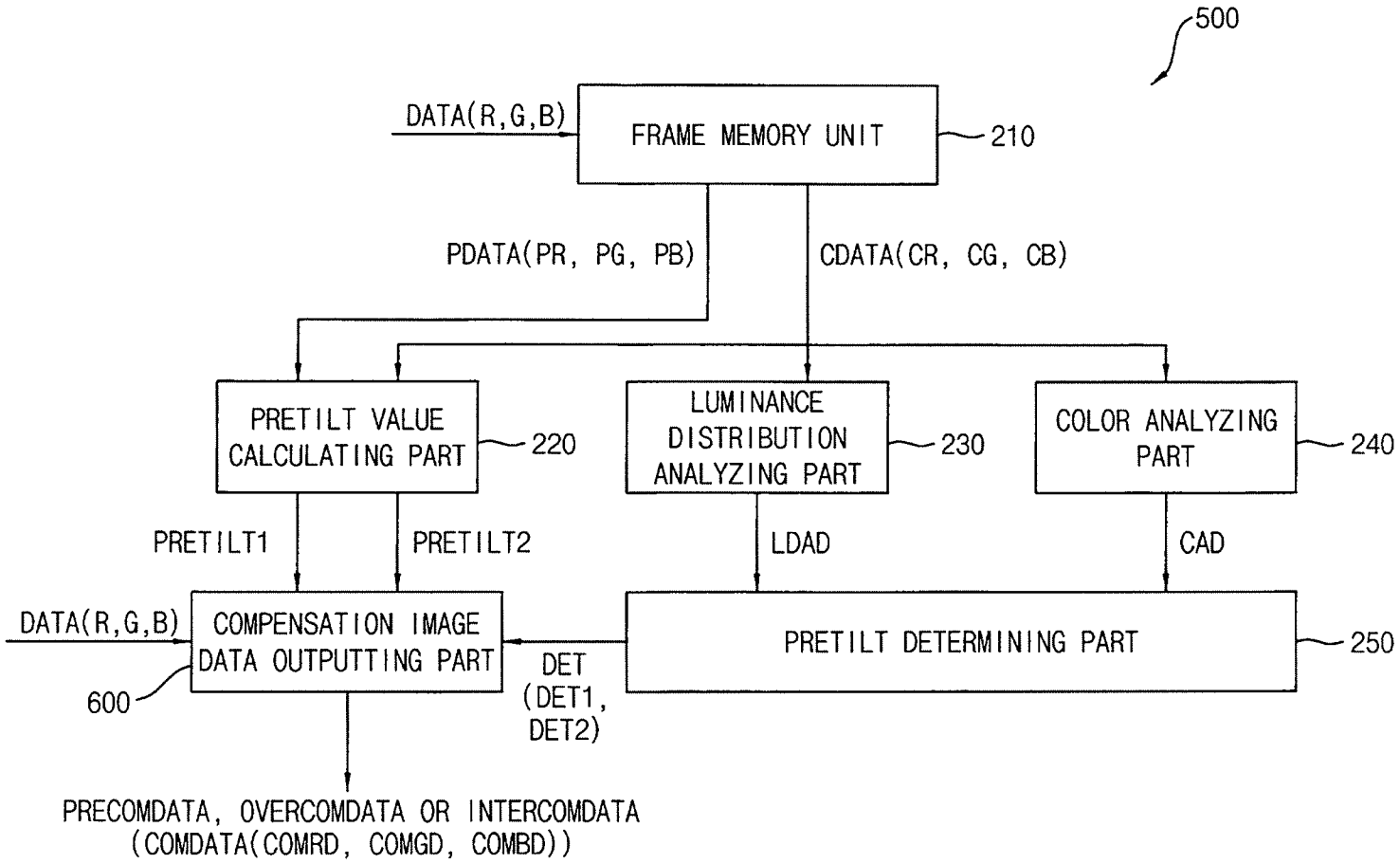
FIG. 9 is a block diagram illustrating a data processing part according to an exemplary embodiment of the present inventive concept.

FIG. 9 is a block diagram illustrating a data processing part 500 according to an exemplary embodiment of the present inventive concept. The data processing part 500 according to the present exemplary embodiment illustrated in FIG. 9 may be included in the display apparatus 100 according to the previous exemplary embodiment illustrated in FIG. 1, and is substantially the same as the data processing part 200 according to the previous exemplary embodiment illustrated in FIGS. 1 and 3 except for a compensation image data outputting part 600. Thus, the same reference numerals will be used to refer to same or like parts as those described in the previous exemplary embodiment and any further repetitive explanation concerning the above elements will be omitted.

Referring to FIG. 9, the data processing part 500 may include the frame memory unit 210, the pretilt value calculating part 220, the luminance distribution analyzing part 230, the color analyzing part 240, the pretilt determining part 250 and the compensation image data outputting part 600.

When the compensation image data outputting part 600 receives the first determination signal DET1 from the pretilt determining part 250, the compensation image data outputting part 600 applies the pretilt to the image data DATA. The pretilt is applied to the image data DATA based on the first pretilt value of the first pretilt signal PRETILT1 and the second pretilt value of the second pretilt signal PRETILT2 to output the pretilt compensation image data PRECOMDATA as the compensation image data COMDATA. In addition, when the compensation image data outputting part 600 receives the second determination signal DET2 from the pretilt determining part 250, the compensation image data outputting part 600 does not apply the pretilt to the image data DATA and outputs over-driving compensation image data OVERCOMDATA or interpolation compensation image data INTERCOMDATA as the compensation image data COMDATA. The over-driving compensation image data OVERCOMDATA may be data obtained by performing a Dynamic Capacitance Compensation DCC method on the image data DATA based on the previous image data PDATA and the current image data CDATA. The interpolation compensation image data INTERCOMDATA may be data obtained compensating the image data DATA. The image data DATA is compensated according to an interpolation method on the image data DATA based on the pretilt compensation image data PRECOMDATA and the over-driving compensation image data OVERCOMDATA.

Figure 10:
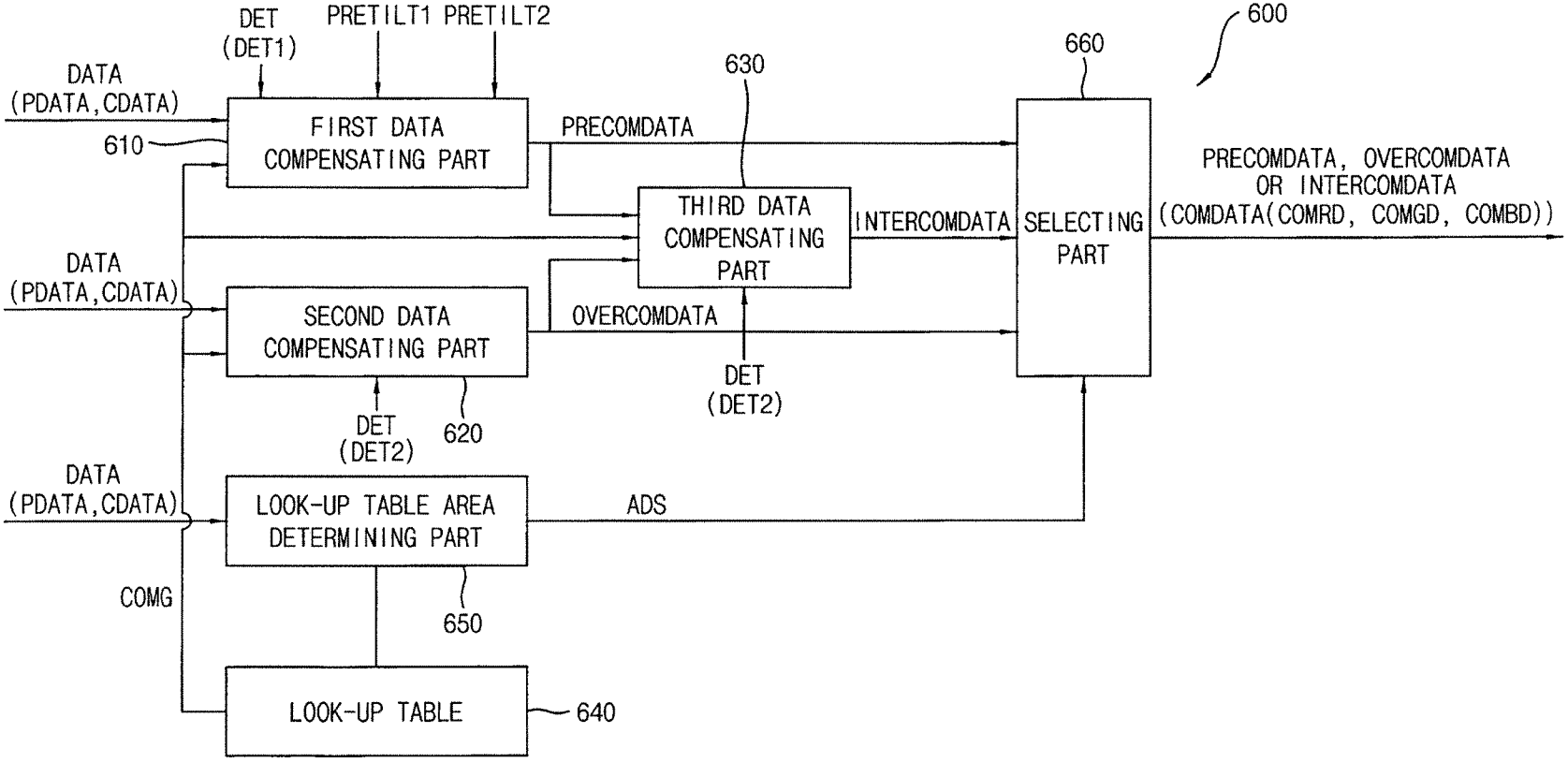
FIG. 10 is a block diagram illustrating a compensation image data outputting part of FIG. 9.

FIG. 10 is a block diagram illustrating the 600 of FIG. 9.

Referring to FIGS. 9 and 10, the compensation image data outputting part 600 may include a first data compensating part 610, a second data compensating part 620, a third data compensating part 630, a look-up table 640, a look-up table area determining part 650 and a selecting part 660.

When the first data compensating part 610, e.g. the first data compensator, receives the first determination signal DET1 of the determination signal DET from the pretilt determining part 250, the first data compensating part 610 applies the pretilt to the image data DATA based on the first pretilt value of the first pretilt signal PRETILT1 and the second pretilt value of the second pretilt signal PRETILT2 to output the pretilt compensation image data PRECOMDATA. The first data compensating part 610 may read a compensation grayscale value COMG from the look-up table 640 to output the pretilt compensation image data PRECOMDATA.

When the second data compensating part 620, e.g. the second data compensator, receives the second determination signal DET2 of the determination signal DET from the pretilt determining part 250, the second data compensating part 620 outputs the over-driving compensation image data OVERCOMDATA based on the previous image data PDATA and the current image data CDATA of the image data DATA. The second data compensating part 620 may read the compensation grayscale value COMG from the look-up table 640 to output the over-driving compensation image data OVERCOMDATA.

When the third data compensating part 630, e.g. the third data compensator, receives the second determination signal DET2 of the determination signal DET from the pretilt determining part 250, the third data compensating part 630 outputs the interpolation compensation image data INTERCOMDATA by compensating the pretilt compensation image data PRECOMDATA and the over-driving compensation image data OVERCOMDATA in the interpolation method. The third data compensating part 630 may read the compensation grayscale value COMG from the look-up table 640 to output the interpolation compensation image data INTERCOMDATA.

Figure 11:
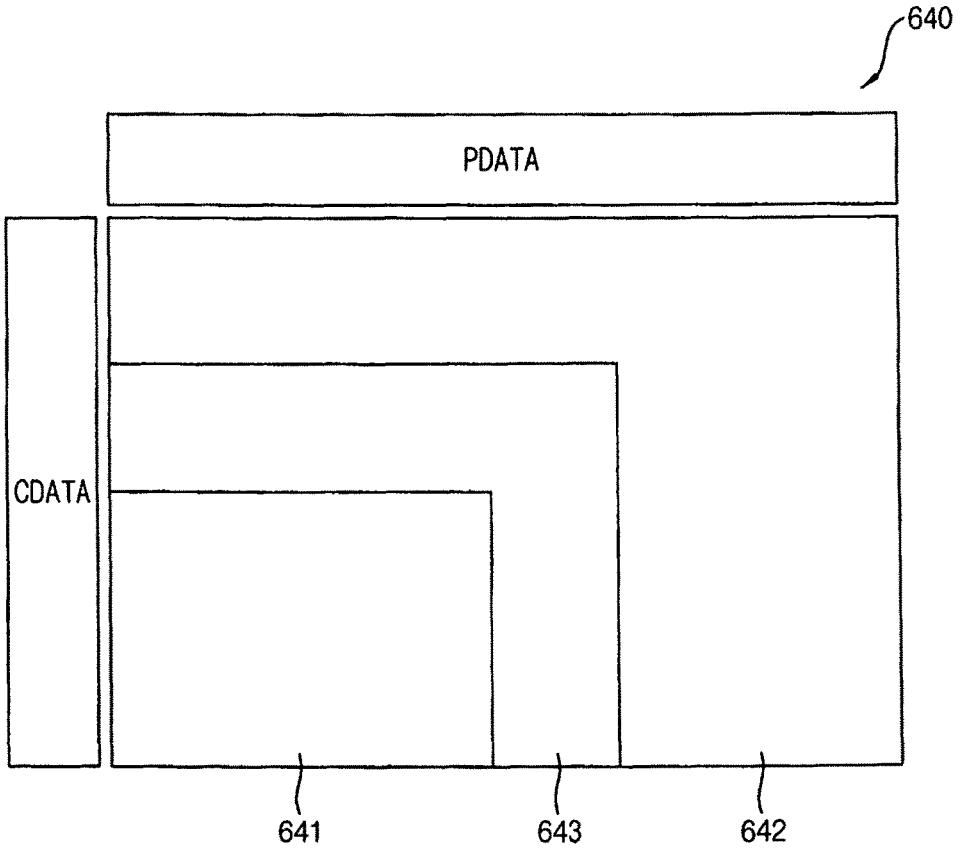
FIG. 11 is a concept diagram illustrating a look-up table of FIG. 10.

FIG. 11 is a concept diagram illustrating the look-up table 640 of FIG. 10.

Referring to FIGS. 10 and 11, the look-up table 640 stores the compensation grayscale value COMG of the pretilt compensation image data PRECOMDATA, the over-driving compensation image data OVERCOMDATA and the interpolation compensation image data INTERCOMDATA corresponding to the previous image data PDATA and the current image data CDATA.

The look-up table 640 may include a first area 641, a second area 642 and a third area 643. The first area 641 may be an area suitable for applying the pretilt to the image data DATA according to the previous image data PDATA and the current image data CDATA. Thus, the first area 641 may be an area of the first data compensating part 610. The second area 642 may be an area unsuitable for applying the pretilt to the image data DATA according to the previous image data PDATA and the current image data CDATA and suitable for outputting the over-driving compensation image data OVERCOMDATA by compensating the image data DATA in the DCC method. Thus, the second area 642 may be an area of the second data compensating part 620. The third area 643 is positioned between the first area 641 and the second area 642. The third area 643 may be an area suitable for outputting the interpolation compensation image data INTERCOMDATA by compensating the image data DATA in the interpolation method based on the pretilt compensation image data PRECOMDATA and the over-driving compensation image data OVERCOMDATA. Thus, the third area 643 may be an area of the third data compensating part 630.

The look-up table area determining part 650 determines whether the previous image data PDATA and the current image data CDATA correspond to the first area 641, the second area 642 or the third area 643 of the look-up table 640 to output an area determination signal ADS.

The selecting part 660 selectively outputs the pretilt compensation image data PRECOMDATA, the over-driving compensation image data OVERCOMDATA and the interpolation compensation image data INTERCOMDATA, in response to the area determination signal ADS output from the look-up table area determining part 650. For example, when the area determination signal ADS has a first level, the selecting part 660 may output the pretilt compensation image data PRECOMDATA as the compensation image data COMDATA. When the area determination signal ADS has a second level different from the first level, the selecting part 660 may output the over-driving compensation image data OVERCOMDATA. When the area determination signal ADS has a third level different from the first level and the second level, the selecting part 660 may output the interpolation compensation image data INTERCOMDATA.

Figure 12:
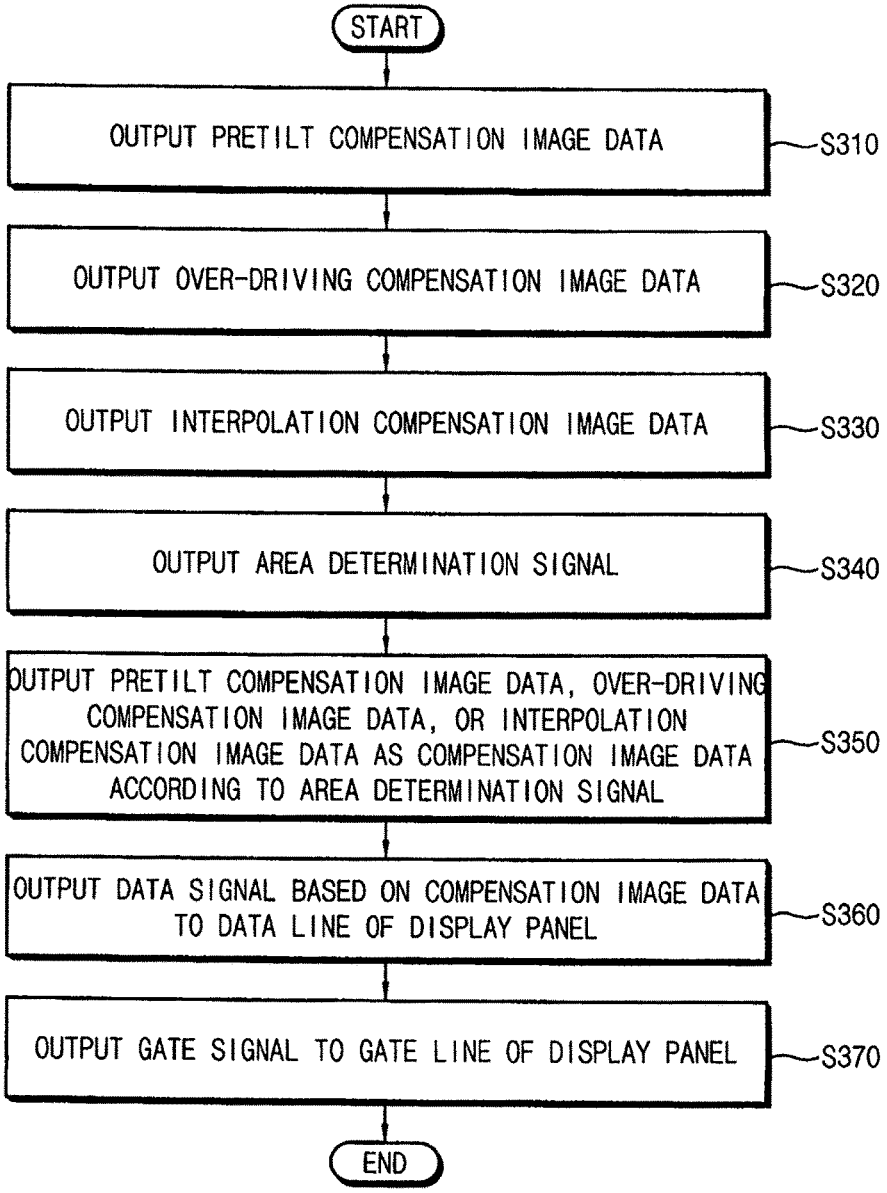
FIG. 12 is a flow chart illustrating a method of driving a display panel performed by a display panel driving apparatus including the data processing part of FIG. 9.

FIG. 12 is a flow chart illustrating a method of driving a display panel performed by a display panel driving apparatus including the data processing part 500 of FIG. 9.

Referring to FIGS. 1 and 9 to 12, the pretilt compensation image data PRECOMDATA is output (step S310). For example, when the first data compensating part 610 receives the first determination signal DET1 of the determination signal DET from the pretilt determining part 250, the first data compensating part 610 applies the pretilt to the image data DATA based on the first pretilt value of the first pretilt signal PRETILT1 and the second pretilt value of the second pretilt signal PRETILT2 to output the pretilt compensation image data PRECOMDATA. The first data compensating part 610 may read the compensation grayscale value COMG from the look-up table 640 to output the pretilt compensation image data PRECOMDATA.

The over-driving compensation image data OVERCOMDATA is output (step S320). For example, when the second data compensating part 620 receives the second determination signal DET2 of the determination signal DET from the pretilt determining part 250, the second data compensating part 620 outputs the over-driving compensation image data OVERCOMDATA. The over-driving compensation image data OVERCOMDATA is based on the previous image data PDATA and the current image data CDATA of the image data DATA. The second data compensating part 620 may read the compensation grayscale value COMG from the look-up table 640 to output the over-driving compensation image data OVERCOMDATA.

The interpolation compensation image data INTERCOMDATA is output (step S330). For example, when the third data compensating part 630 receives the second determination signal DET2 of the determination signal DET from the pretilt determining part 250, the third data compensating part 630 outputs the interpolation compensation image data INTERCOMDATA by compensating the pretilt compensation image data PRECOMDATA and the over-driving compensation image data OVERCOMDATA in the interpolation method. The third data compensating part 630 may read the compensation grayscale value COMG from the look-up table 640 to output the interpolation compensation image data INTERCOMDATA.

The area determination signal ADS is output (step S340). For example, the look-up table area determining part 650 determines whether the previous image data PDATA and the current image data CDATA correspond to the first area 641, the second area 642 or the third area 643 of the look-up table 640 to output an area determination signal ADS.

The pretilt compensation image data PRECOMDATA, the over-driving compensation image data OVERCOMDATA, or the interpolation compensation image data INTERCOMDATA is output, according to the area determination signal ADS (step S350). For example, the selecting part 660 selectively outputs the pretilt compensation image data PRECOMDATA, the over-driving compensation image data OVERCOMDATA and the interpolation compensation image data INTERCOMDATA, in response to the area determination signal ADS output from the look-up table area determining part 650. For example, when the area determination signal ADS has the first level, the selecting part 660 may output the pretilt compensation image data PRECOMDATA as the compensation image data COMDATA. When the area determination signal ADS has the second level different from the first level, the selecting part 660 may output the over-driving compensation image data OVERCOMDATA. When the area determination signal ADS has the third level different from the first level and the second level, the selecting part 660 may output the interpolation compensation image data INTERCOMDATA.

The data signal DS based on the compensation image data COMDATA is output to the data line DL of the display panel 110 (step S360). For example, the data driving part 140 outputs the data signals DS based on the compensation image data COMDATA to the data line DL in response to the horizontal start signal STH and the second clock signal CLK2 provided from the timing controlling part 150.

The gate signal GS is output to the gate line GL of the display panel 110 (step S370). For example, the gate driving part 130 generates the gate signal GS in response to the vertical start signal STV and the first clock signal CLK1 provided from the timing controlling part 150, and outputs the gate signal GS to the gate line GL.

According to the present exemplary embodiment, the processor determines when it is suitable to apply the pretilt to the image data DATA according to the previous image data PDATA and the current image data CDATA, the data processing circuit 500. Applying the pretilt to the image data DATA when suitable may prevent color distortion of an image.

According to an exemplary embodiment, a method of driving a display panel using the display panel driving apparatus. A data processing part applies a pretilt to image data according to a luminance distribution of unit pixels and a color pixel(s) to which the pretilt is applied to output compensation image data. Therefore, a response speed of a display panel may be improved and color distortion may be prevented.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the teachings of the inventive concept. Accordingly, all such modifications are intended to be included within the scope of the present inventive concept as defined in the claims.

What is claimed is:

1. A display panel driving apparatus comprising:

a processor configured to receive an image data and generate a determination signal based on a current image data derived from the image data, wherein the determination signal is based at least in part on color analysis data based on a comparison among a plurality of color pixels within a unit pixel;

the processor including:

a frame memory unit configured to store the image data, and output a previous image data and the current image data;

a pretilt value calculator configured to calculate a first pretilt value of the previous image data, calculate a second pretilt value of the current image data and output the first pretilt value and the second pretilt value; and an image data compensator configured to selectively output the image data or a pretilt compensation image data according to the first pretilt value, the second pretilt value and the determination signal, and to compensate the current image data based on the previous image data and the current image data to output an over-driving compensation image data using dynamic capacitance compensation;

a data driver configured to generate a data signal based on the pretilt compensation image data output from the processor, and output the data signal to a data line of a display panel; and a gate driver configured to output a gate signal to a gate line of the display panel, wherein the image data compensator comprises:

a first data compensator configured to output the pretilt compensation image data;

a second data compensator configured to compensate the current image data based on the previous image data and the current image data to output the over-driving compensation image data using the dynamic capacitance compensation;

a third data compensator configured to interpolate the pretilt compensation image data and the over-driving compensation image data to output the interpolation compensation image data;

a look-up table configured to store compensation grayscale values of the pretilt compensation image data, the over-driving compensation image data and the interpolation compensation image data corresponding to the previous image data and the current image data;

a look-up table area determiner configured to determine whether the previous image data and the current image data correspond to an area of the first data compensator, which is a first area of the look-up table, an area of the second data compensator, which is a second area of the look-up table, or an area of the third data compensator, which is a third area of the look-up table, to output an area determination signal; and a selector configured to selectively output the pretilt compensation image data, the over-driving compensation image data and the interpolation compensation image data in response to the area determination signal.

2. The display panel driving apparatus of claim 1, wherein the processor further comprises:

a luminance distribution analyzer configured to analyze a luminance distribution of a plurality of the unit pixels from the current image data to generate an output of a luminance distribution analysis data, wherein each unit pixel includes M*N subpixels and M and N are natural numbers, wherein the determination signal is based at least in part on the luminance distribution;

a color analyzer configured to analyze the plurality of color pixels to output the color analysis data; and a pretilt determiner configured to output the determination signal indicating whether a pretilt is applied to the image data or the pretilt is not applied to the image data, according to the luminance distribution analysis data and the color analysis data.

3. The display panel driving apparatus of claim 2, wherein the unit pixel of the plurality of unit pixels includes a first color pixel, a second color pixel and a third color pixel, and the color analyzer indicates whether the pretilt is applied to one or more of the first to third color pixels and outputs the color analysis data.

4. The display panel driving apparatus of claim 3, wherein, when the color analysis data output from the color analyzer indicates that the pretilt is applied to the first to third color pixels, the pretilt determiner outputs a first determination signal indicating that the pretilt is applied to the image data.

5. The display panel driving apparatus of claim 4, wherein, when the image data compensator receives the first determination signal from the pretilt determiner, the image data compensator applies the pretilt to the image data based on the first pretilt value and the second pretilt value to output the pretilt compensation image data.

6. The display panel driving apparatus of claim 3, wherein, when the color analysis data output from the color analyzer indicates that the pretilt is applied to one color pixel, the pretilt determiner outputs a first determination signal indicating that the pretilt is applied to the image data.

7. The display panel driving apparatus of claim 6, wherein, when the image data compensator receives the first determination signal from the pretilt determiner, the image data compensator applies the pretilt to the image data based on the first pretilt value and the second pretilt value to output the pretilt compensation image data.

8. The display panel driving apparatus of claim 3, when the color analysis data output from the color analyzer indicates that the pretilt is applied to two color pixels and the pretilt is not applied to one color pixel, the pretilt determiner outputs a second determination signal indicating that the pretilt is not applied to the image data.

9. The display panel driving apparatus of claim 8, wherein, when the image data compensator receives the second determination signal from the pretilt determiner, the image data compensator does not apply the pretilt to the image data and outputs the image data.

10. The display panel driving apparatus of claim 2, wherein the luminance distribution analysis data output from the luminance distribution analyzer indicates a luminance similarity between the unit pixels.

11. The display panel driving apparatus of claim 10, wherein, when the luminance similarity between the unit pixels is not less than a reference value according to the luminance distribution analysis data, the pretilt determiner outputs a first determination signal indicating the pretilt is applied to the image data.

12. The display panel driving apparatus of claim 1, wherein the display panel includes a first unit pixel having an M*N subpixels and a second unit pixel having M*N subpixels, and the image data compensator applies a high pretilt to image data corresponding to the first unit pixel among the image data and applies a low pretilt to image data corresponding to the second unit pixel among the image data, according to the determination signal output from a pretilt determiner.

13. The display panel driving apparatus of claim 1, wherein the image data compensator comprises:

a first data compensator configured to output the pretilt compensation image data;

a second data compensator configured to output a saturation grayscale image data corresponding to a maximum response speed of a liquid crystal in the display panel at a boundary section of data of a maximum black grayscale value and a minimum white grayscale value, when the previous image data has 0 to the maximum black grayscale value and the current image data has the minimum white grayscale value to a maximum white grayscale value; and a look-up table configured to store a saturation grayscale value of the saturation grayscale image data corresponding to the previous image data and the current image data.

14. The display panel driving apparatus of claim 13, wherein the image data compensator further comprises:

a look-up table area determiner configured to determine whether the previous image data and the current image data correspond to an area of the first data compensator, which is a first area of the look-up table or an area of the second data compensator, which is a second area of the look-up table, to output an area determination signal, wherein the first area and the second area each comprise a plurality of entries; and a selector configured to selectively output the pretilt compensation image data and the saturation grayscale image data in response to the area determination signal.

15. A method of driving a display panel, the method comprising:

receiving image data and outputting a previous image data and a current image data;

calculating a first pretilt value of the previous image data to output a first pretilt signal and calculating a second pretilt value of the current image data to output a second pretilt signal;

analyzing a luminance distribution of unit pixels from the current image data to output a luminance distribution analysis data;

analyzing a color pixel to which a pretilt is applied based on the unit pixel from the current image data to output a color analysis data;

outputting a determination signal indicating whether or not the pretilt is applied to the image data according to the luminance distribution analysis data and the color analysis data;

outputting the image data or a pretilt compensation image data according to the first pretilt signal, the second pretilt signal and the determination signal; and compensating the current image data based on the previous image data and the current image data to output an over-driving compensation image data using dynamic capacitance compensation, and compensating the current image data by interpolating the pretilt compensation image data and the over-driving compensation image data to output an interpolation compensation image data;

determining whether the previous image data and the current image data correspond to a first area of a look-up table, a second area of the look-up table, or a third area of the look-up table to output an area determination signal; and selectively outputting the pretilt compensation image data, the over-driving compensation image data and the interpolation compensation image data in response to the area determination signal.

16. The method of claim 15, further comprising:

outputting a saturation grayscale image data corresponding to a maximum response speed of a liquid crystal in the display panel at a boundary section of data of a maximum black grayscale value and data of a minimum white grayscale value, when the previous image data has 0 to the maximum black grayscale value and the current image data has the minimum white grayscale value to a maximum white grayscale value;

determining whether the previous image data and the current image data correspond to a first area of a look-up table or a second area of the look-up table to output an area determination signal; and selectively outputting the pretilt compensation image data and the saturation grayscale image data in response to the area determination signal.

17. A display apparatus comprising:

a display panel configured to display an image; and a display panel driver comprising:

a data driver configured to generate a data signal based on a pretilt compensation image data output from a processor and to output the data signal to a data line of the display panel;

a gate driver configured to output a gate signal to a gate line of the display panel; and the processor configured to generate a determination signal based on a current image data derived from the image data, wherein the determination signal is based at least in part on a luminance distribution across a plurality of unit pixels, wherein the processor includes:

a frame memory unit configured to receive an image data, and output a previous image data and the current image data;

a pretilt value calculator configured to calculate a first pretilt value of the previous image data, calculate a second pretilt value of the current image data and output the first pretilt value and the second pretilt value; and an image data compensator configured to selectively output the image data or the pretilt compensation image data according to the first pretilt value, the second pretilt value and the determination signal, to compensate the current image data based on the previous image data and the current image data to output an over-driving compensation image data using dynamic capacitance compensation, wherein the image data compensator comprises:

a first data compensator configured to output the pretilt compensation image data;

a second data compensator configured to compensate the current image data based on the previous image data and the current image data to output the over-driving compensation image data using the dynamic capacitance compensation;

a third data compensator configured to interpolate the pretilt compensation image data and the over-driving compensation image data to output interpolation compensation image data;

a look-up table configured to store compensation grayscale values of the pretilt compensation image data, the over-driving compensation image data and the interpolation compensation image data corresponding to the previous image data and the current image data;

a look-up table area determiner configured to determine whether the previous image data and the current image data correspond to an area of the first data compensator, which is a first area of the look-up table, an area of the second data compensator, which is a second area of the look-up table, or an area of the third data compensator, which is a third area of the look-up table, to output an area determination signal; and a selector configured to selectively output the pretilt compensation image data, the over-driving compensation image data and the interpolation compensation image data in response to the area determination signal.

18. The display apparatus of claim 17, wherein the display panel driver further comprises:

a luminance distribution analyzer configured to analyze a luminance distribution of the unit pixels from the current image data to output a luminance distribution analysis data, wherein each unit pixel includes M*N subpixels and M and N are natural numbers;

a color analyzer configured to analyze a plurality of color pixels to output color analysis data, wherein the determination signal is based at least in part on the color analysis data; and a pretilt determiner configured to output the determination signal indicating whether pretilt is applied to the image data or the pretilt is not applied to the image data, according to the luminance distribution analysis data and the color analysis data.

* * * * *